US006502980B1

(12) United States Patent
Ekstrom et al.

(10) Patent No.: US 6,502,980 B1
(45) Date of Patent: Jan. 7, 2003

(54) IN-LINE HOMOGENIZER USING ROTORS AND STATORS IN A HOUSING FOR CREATING EMULSIONS, SUSPENSIONS AND BLENDS

(75) Inventors: David R. Ekstrom, Beverly, MA (US); Matthew L. Ekstrom, Beverly, MA (US); Richard P. Bennett, Danvers, MA (US)

(73) Assignee: Bematek Systems Inc, Beverly, MA (US)

( * ) Notice: Subject to any disclaimer, the term of this patent is extended or adjusted under 35 U.S.C. 154(b) by 0 days.

(21) Appl. No.: 09/834,829

(22) Filed: Apr. 13, 2001

(51) Int. Cl.[7] ..... B01F 7/04
(52) U.S. Cl. ..... 366/305; 366/307
(58) Field of Search ..... 366/168.1, 171.1, 366/172.2, 174.1, 175.2, 176.1, 302, 305, 307, 315–317

(56) References Cited

U.S. PATENT DOCUMENTS 1,727,753 A * 9/1929 De Bethune
2,092,992 A * 9/1937 Thalman
2,169,338 A * 8/1939 Ditto
2,240,841 A * 5/1941 Flynn
2,734,728 A * 2/1956 Myers
2,774,577 A * 12/1956 Anderson et al.
2,798,698 A * 7/1957 Dooley
2,960,318 A * 11/1960 Caillaud
3,188,183 A * 6/1965 Logan
4,039,149 A * 8/1977 Gajdos
4,874,248 A * 10/1989 Luetzelschwab
4,915,509 A * 4/1990 Sauer et al.
4,974,292 A * 12/1990 Currier et al.
5,655,834 A * 8/1997 Dickson
5,810,474 A * 9/1998 Hidalgo
5,868,495 A * 2/1999 Hidalgo
6,337,308 B1 * 1/2002 Adams et al.

* cited by examiner

*Primary Examiner*—Charles E. Cooley

(57) ABSTRACT

The present invention comprises an in-line mixer apparatus for creating output emulsions, homogeneous blends, suspensions and dispersions of pharmaceutical, biological, cosmetic, chemical and food compositions. The mixer includes a drive motor arranged around a support, the motor having an output shaft extending therefrom which is connectable to a drive head. A seal hub is arranged around the shaft, and a plurality of alternation foraminous stator plates and rotors are also arranged about the shaft. An inlet and an emulsion or dispersion discharge is arranged in the drive head. Each of the rotors comprises a plurality of projections for improved compound flow therepast, each projection having a leading cutting edge blade arranged at an acute angle with respect to a frame portion of said rotor member.

4 Claims, 3 Drawing Sheets

IN-LINE HOMOGENIZER USING ROTORS AND STATORS IN A HOUSING FOR CREATING EMULSIONS, SUSPENSIONS AND BLENDS

BACKGROUND OF THE INVENTION

1. Field of the Invention

This invention relates to in-line mixers and colloid mills and blades for such in-line mixers and colloid mills and more particularly to cutting blades for creating emulsions, suspensions, blends and dispersions.

2. Prior Art

In-line type mixers are precision machinery arranged to process pharmaceutical, biotechnology, cosmetic, chemical and food preparation to generate emulsions and dispersions thereof. In such machines, during the processing of such an emulsion or dispersion, rotating blades (sometimes called turbines) must impart a high shear to the product passing therethrough. Such emulsion or dispersion must be driven through the process smoothly and uniformly by proper rotors or blades therewithin.

It is an object of the present invention, to provide an optimum flow arrangement through the, processing chamber than that found in prior art.

It is a further object of the present invention, to provide a rotor blade arrangement having superior emulsifying characteristics.

BRIEF SUMMARY OF THE INVENTION

The present invention relates to an in-line mixer to permit the operation of multiple mixing and milling heads arrayed in a series within a single drive section. A drive motor is arranged with an input shaft in-line with an input head. The drive head comprises a generally cylindrically shaped housing surrounding the output of the drive motor. The housing has a proximal end which comprises a flanged ring which can be attached to the drive motor. The housing has a clamp ring flange which is attached to a flange of an output head. The housing has a feed line comprising a port for forced flow release of pharmaceutical, biotechnological, cosmetic, chemical or food compounds therethrough.

In one embodiment, the drive shaft extends centrally through the housing having a blade and stator arrangement thereattached. A seal hub is positioned around the drive shaft adjacent to the clamp ring. The seal hub has a cone shaped truncated outer peripheral surface for passage of materials out of the emulsifying and dispersion chamber downstream thereof. In another embodiment, a separate drive shaft can be remote from the housing and driven by a remote motor attached, for example, by a drive belt or a coupling. In both embodiments, a proximal or first rotor blade arrangement is mated with the drive shaft distal of the hub seal. The drive shaft extends therefrom through a foraminous stator plate. The mid or second rotor blade is arranged distally of the first stator plate and a second foraminous stator plate is arranged distally of the second or midrotor blade arrangement. The mid or second rotor blade arrangement thus spins between the two foraminous stator plates which are stationary. A third rotor blade arrangement is disposed around the end of the drive shaft distally of the second foraminous stator plate. If desired, the blade and stator arrangement can be repeated as many times as is necessary for completion of the mixing and more than one rotor blade can be disposed before a foraminous stator. A locking cap is attached to the distalmost end of the drive shaft within the upstream end of the receiving chamber of the input head.

An input orifice is arranged within the input head to permit the emulsion and/or dispersion to be delivered therethrough. The foraminous stator plates in the preferred embodiment are disposed between the first and second rotor blade arrangement and between the second and third rotor blade arrangement. The plates have a plurality of passageways or openings which can be spaced on a plurality of circular paths therearound. The passageways are sized to permit the shear and turbulence required for the flow of compound therethrough while providing proper axial directionality thereof to the rotor blades rotating on either side thereof and also to provide the shear and turbulence required for the process.

Each rotor blade arrangement has at least two, and preferably three or more, equally spaced apart projections thereon. Each projection has a leading edge or blade, which in plan view, is arranged at an acute angle with respect to its adjacent frame edge and thereby form a throat for the flow of material. Each projection has a trailing edge of the blade which comprises a back surface thereof. The surface between the leading edge and the trailing edge of the blade on the projection is sloped to provide the force and directionality to compounds being emulsified or dispersed as the blade of the rotor rotates. The leading edge of the blade is arranged so it is not parallel or in alignment with the radius of rotation of the rotor blade. The leading edge of each blade defines an acute angle with respect to the frame edge. Thus, an acute angle is formed by the leading edge with respect to the side of the frame of the blade to provide an angled (non-radially oriented) sweeping and cutting action through the throat between adjacent projections across the passageways or openings in the face of the respective foraminous stator plates. By virtue of the acute angle. As the leading edge crosses the passageways of the stator plate, the compounds are imparted with a disorienting force to the components passing therethrough for increased dispersion an emulsification thereof. Preferably, one or more small vanes are disposed in the crotches between adjacent projections near the axis to enhance turbulence between the individual projections.

The invention thus comprises an in-line mixer apparatus for creating output emulsions and dispersions of pharmaceutical, biological, cosmetic, chemical and food compositions and includes a drive motor arranged around a support which has the motor shaft extending therefrom and can lead into a drive head. It further includes a seal hub arranged on the shaft and a plurality of alternating foraminous stator plates and rotors arranged about the shaft and a component inlet arranged through a distalmost end of the drive head. Each of the rotors can be a generally polygonal shaped member for improved compound flow therepast. Each of the rotors has an arrangement of at least two projections thereon, each of the projections having a leading blade edge and a trailing edge. A sloped surface is arranged between the leading edge and the trailing edge. Each of the rotors has a frame edge defining a side of the projection and each leading edge is arranged at an acute angle with respect to said frame edge. Each of the stator plates has an array of foramina which can comprise one or more annular, spaced-apart rows of openings therein for flow of emulsion and dispersion therethrough.

BRIEF DESCRIPTION OF THE DRAWINGS

The objects and advantages of the present invention will become more apparent when viewed in conjunction with the following drawings, in which.

DESCRIPTION OF THE PREFERRED EMBODIMENTS

Figure 1:
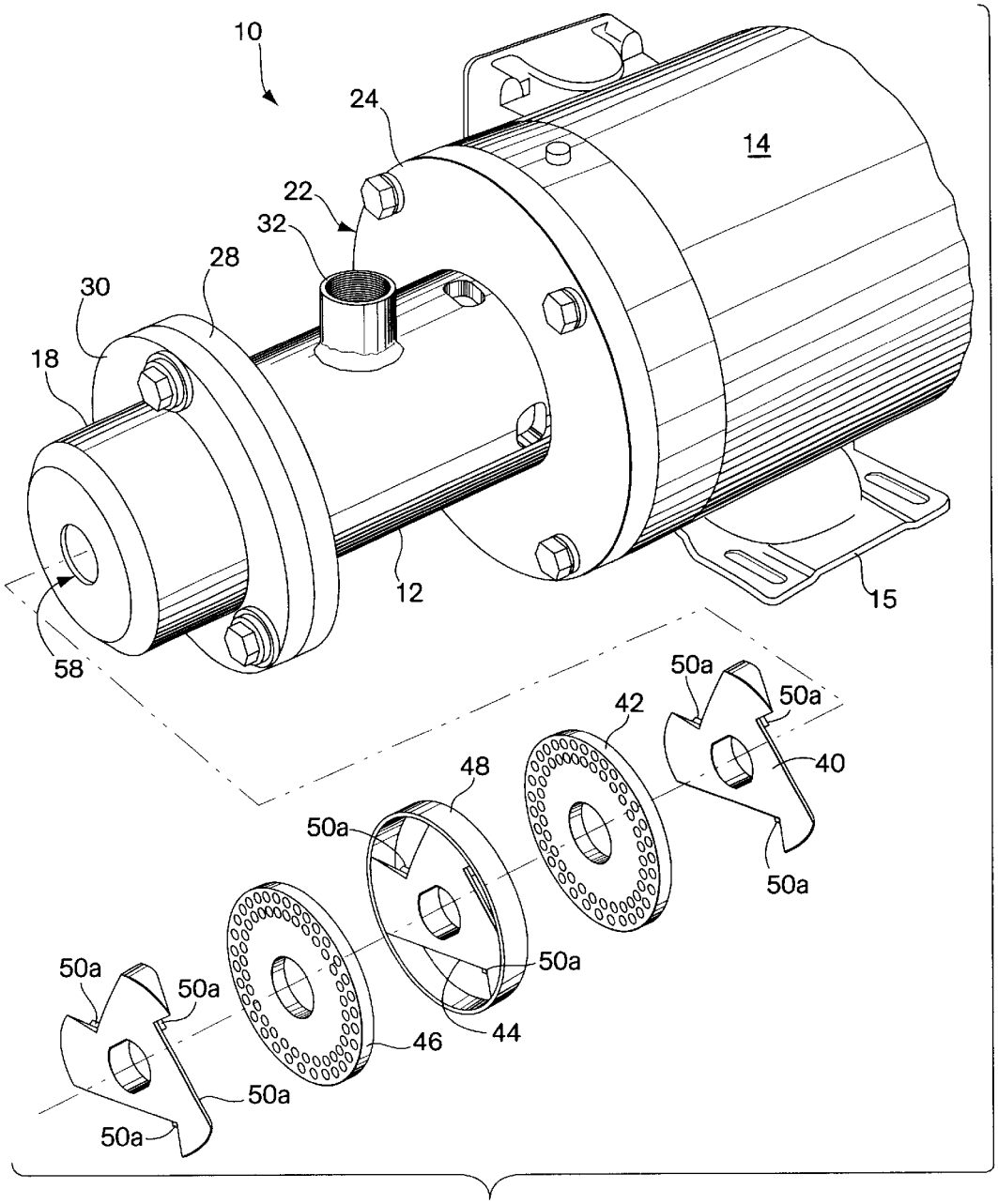
FIG. 1 is a perspective of an in-line mixer constructed according to the principles of the present invention. Internal parts of the mixer are shown as an exploded view beneath the mixer.
Figure 2:
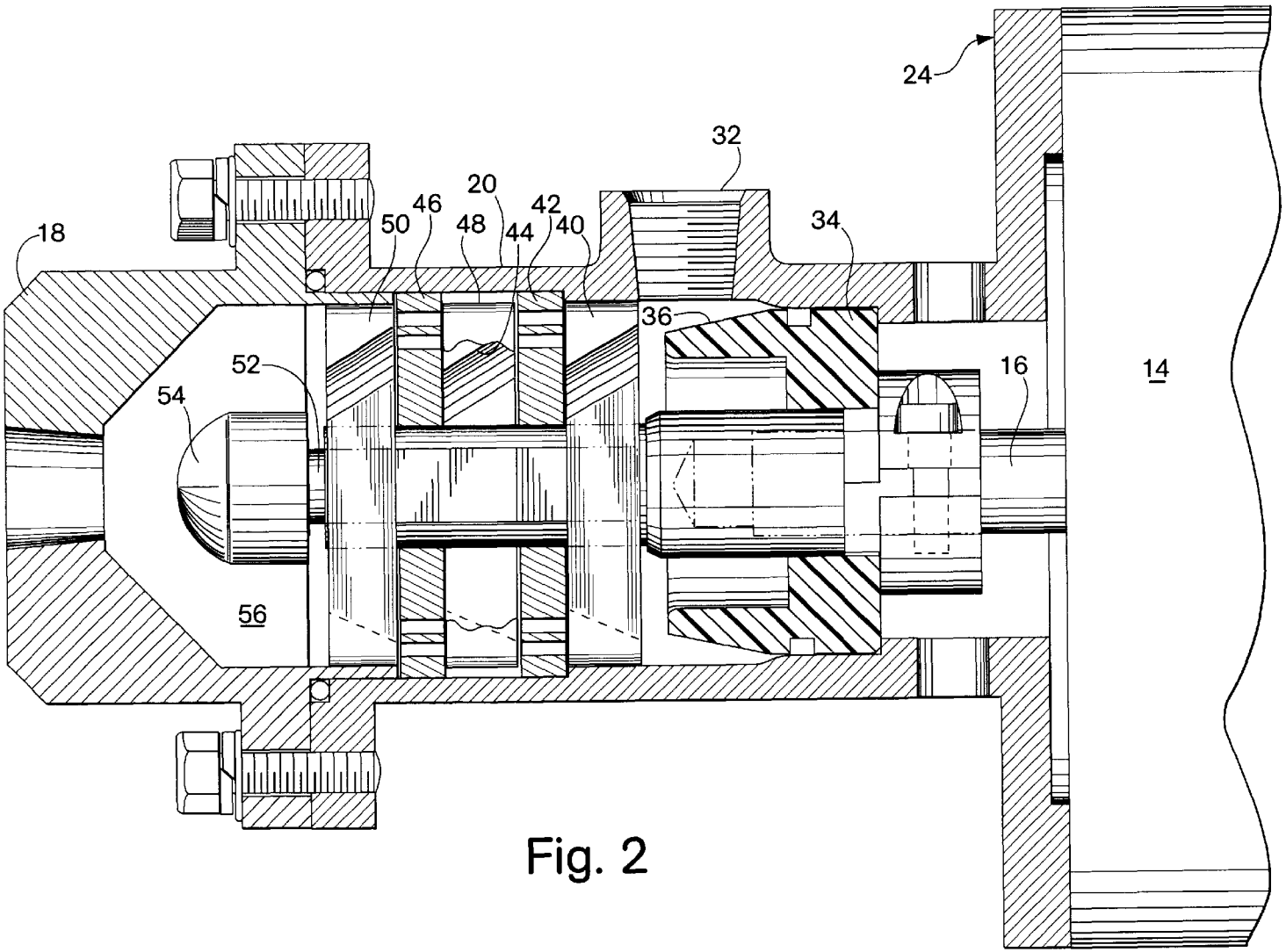
FIG. 2 is a side elevational view, in section, of the drive head of the in-line mixer shown in FIG. 1.

Referring now to the drawing in detail, and particularly to FIG. 1, there is shown the present invention which comprises an in-line mixer 10 to permit the operation of multiple mixing and milling heads arrayed in a series within a single drive section 12. A drive motor 14 is arranged on a support 15, the motor having an output or drive shaft which is in line with an input section 18. Mounted beside the input section 18 is a generally cylindrically shaped housing 20 surrounding an extension of the output shaft of the drive motor 14, as may be seen in FIG. 2.

The housing 20 has a proximal end 22 which comprises a flanged ring 24 attached to the drive motor 14. The housing 12 has a clamp ring flange 28 which is attached to a flange 30 of the input head 18. The housing 20 has a discharge port 32 comprising a port for forced flow release of pharmaceutical, biotechnological, cosmetic, chemical or food components therefrom.

The drive shaft 16 extends centrally through the housing 20 having a blade and stator arrangement thereattached. A seal hub 34 is disposed around the drive shaft 16 adjacent to the clamp ring 24. The seal hub 34 has a cone shaped truncated outer peripheral surface 36 for passage of compounds into the radially adjacent discharge port 32. A proximal or first rotor blade arrangement 40 is mated onto the drive shaft 16 distal of the seal hub 34. The drive shaft 16 extends distally therefrom through a first foraminous stator plate 42. The mid or second rotor blade 44 is arranged distally of the first stator plate 42 and a second foraminous stator plate 46 is arranged distally of the second or midrotor blade arrangement 44. The plates 42 and 46 are fixed within the housing 20. The mid or second rotor blade arrangement 44 thus spins between the two foraminous stator plates 42 and 46, which are stationary. A third or distal rotor blade arrangement 50 is disposed on the distal end 52 of the drive shaft 16 distally of the second foraminous stator plate 46, The rotors 40, 44 and 50 are attached to the rotatable shaft 16. Each of rotor blades 40, 44 and 50 are disposed within a ring 48 (only one of which is shown) within which they rotate. A locking cap 54 is attached to the distal-most end of the drive shaft 16 within the receiving chamber 56 of the input head 18.

Figure 5:
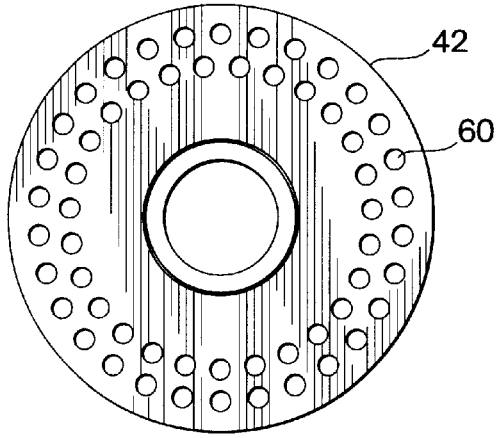
FIG. 5 is a plan view of the stator plate of the present invention.

An orifice 58 is arranged within the input head 18 to permit the emulsion and/or dispersion to be delivered therethrough. The foraminous stator plates 42 and 46 in the preferred embodiment, disposed between the first and second rotor blade arrangement 40 and 44 and between the second and third rotor blade arrangements 44 and 50, comprise a stainless steel plate or ring, as for example, may be seen more clearly in FIG. 5. The plates 42 and 46, only shown for example in FIG. 5, have a plurality of passageways or openings 60 spaced along a plurality of circular paths therearound, preferably at least two. The passageways 60 are sized to permit the flow of compound therethrough while providing proper axial directionality thereof to the rotor blades 40, 44 and 50 rotating on either side thereof. Moreover, the trailing edges 76 of rotor blades 44 and 50 scrape by and cross the passageways 60 of the stator plates 42 and 46 thereby enhancing the dispersion and emulsification of the solids passing therethrough.

Figure 3:
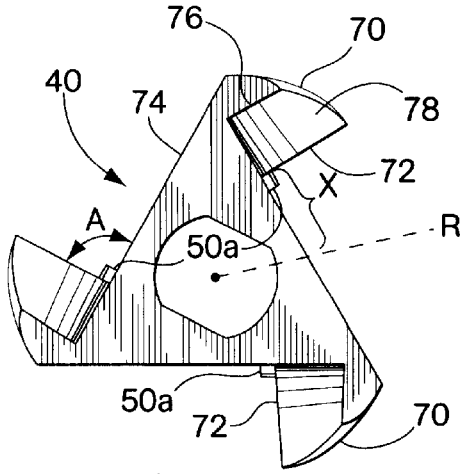
FIG. 3 is a plan view of the rotor blade arrangement of the present invention.
Figure 4:
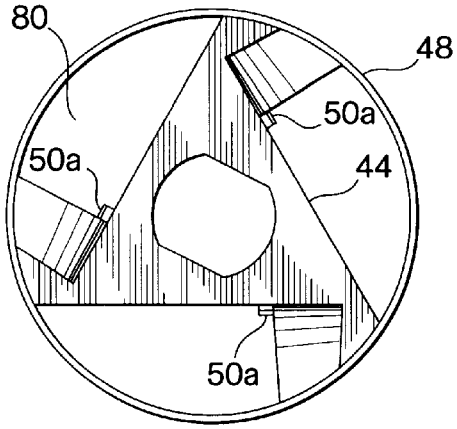
FIG. 4 is a plan view of the rotor blade arrangement within the housing of the present invention.

Each rotor blade arrangement 40, 44 and 50, only one of which is shown for example in FIGS. 3 and 4, are of generally polygonal configuration, and have three equally spaced-apart projections 70 thereon. While three projections are shown, two or more (generally up to five or six) can be used. Each projection 70 has a leading edge or blade 72, which, in plan view, is arranged at an acute angle "A" with respect to its adjacent frame edge 74. Each projection 70 has a trailing edge 76 which engages material entering from openings 60 in stator plates 42 and 46. These projections 70 comprise a back surface of the blade 72. The surface between the leading edge 72 and the trailing edge 76 of the blade is a sloped surface 78 on the projection 70, which provides the force and directionality to compounds being emulsified or dispersed as the projection 70 of the rotors 40 (or 44 or 50 from FIG. 1) rotate. The spaces between adjacent projections form throats 80 through which fluids flow. Additional projections shown, for example, as 50*a* in FIGS. 1, 3, and 4 can be disposed in the crotches between the projections 70 to aid in the flow of material being treated. The leading edge 72 of the projection 70 is arranged so it is not in alignment with the radius "r" of rotation of each projection 70 but is parallel to and trails the parallel radius "r" by an arc segment "x", that is spaced apart an arcuate distance from the radius "r" when the radius "r" and the leading edge 72 are parallel. Thus such a relationship permits the acute angle "A" of the leading edge 72 with respect to the side of the frame 74 of the projection 70 to scrape across the surface of their adjacent plate and provide an arcutely angled (non-radially oriented) sweeping and cutting action across the passageways or openings 60 in the face of the respective foraminous stator plates 42 and 46. By virtue of the acute angle "A" as the leading edge 72 crosses the passageways 60 of the stator plates 42 and 46, the compounds may be given or imparted with the disorienting force to the components there-through for increased dispersion an emulsification thereof.

It is apparent that modifications and changes may be made within the spirit and scope of the present invention, but it is our intention only to be limited by the scope of the following claims.

As our invention, we claim:

1. An in-line mixer apparatus for creating output emulsions and dispersions of pharmaceutical, biological, cosmetic, chemical and food compositions, said mixer arranged to be powered by a drive motor, said mixer comprising:

a seal hub arranged around a shaft and disposed in a housing, said shaft arranged to be powered by said motor;

an alternating plurality of rotors and foraminous stator plates arranged about said shaft, said rotors and stator plates disposed within said housing, each of said rotors having a radius and an axis of rotation, said rotors each having an arrangement of at least two projections thereon, each of said projections having a leading edge, a trailing edge and a sloped surface between said leading edge and said trailing edge, each of said sloped surfaces sloping in the same direction, said leading edge arranged to be out of alignment with said radius and disposed to scrape by the foramen of one stator and provide a disorienting force whereby to draw material into a throat formed between said leading edge and said trailing edge, said trailing edge being arranged to scrape by the foramen another stator and force emulsions and dispersions into the foramen of an adjacent foraminous stator plate whereby to provide shear and turbulence thereby increasing dispersion and emulsification; and a feed tube disposed on a distal end of said housing and an emulsion or dispersion discharge means arranged through a proximal end of said housing.

2. The in-line mixer apparatus as recited in claim 1 wherein each of said rotors has a frame edge defining a side of said throat, and each said leading edge is arranged at an acute angle with respect to said frame edge.

3. The in-line mixer apparatus as recited in claim 1 wherein said leading edge is parallel to and spaced apart from the radius of rotation of said rotor.

4. The in-line mixer apparatus as recited in claim 1, wherein further including small vanes in the crotches between adjacent projections whereby to enhance turbulance between said projections.

* * * * *